United States Patent [19]

Yasuda et al.

[11] Patent Number: 4,986,450

[45] Date of Patent: Jan. 22, 1991

[54] TONER CARTRIDGE

[75] Inventors: Shinichiro Yasuda; Yasunori Inagaki, both of Wakayama, Japan

[73] Assignee: Kao Corporation, Tokyo, Japan

[21] Appl. No.: 407,935

[22] Filed: Sep. 15, 1989

[30] Foreign Application Priority Data

Sep. 19, 1988 [JP] Japan ..... 63-122321
Sep. 19, 1988 [JP] Japan ..... 63-122322

[51] Int. Cl.[5] ..... B67D 5/64

[52] U.S. Cl. ..... 222/169; 222/240; 222/325; 222/342; 222/406; 222/DIG. 1

[58] Field of Search ..... 222/325, 342, 414, 406, 222/240, 169, 167, 459, DIG. 1

[56] References Cited

U.S. PATENT DOCUMENTS

| | | | |
|---|---|---|---|
| 154,870 | 9/1874 | Johnson | 222/342 |
| 844,124 | 2/1907 | Halliday | 222/459 X |
| 1,573,493 | 2/1926 | Heyd | 222/240 |
| 2,533,386 | 12/1950 | Masters | 222/414 X |
| 2,628,002 | 2/1953 | Peterson | 222/240 |
| 2,645,384 | 7/1953 | Juzwiak et al. | 222/240 |
| 3,432,884 | 3/1969 | Lysakowski et al. | 222/414 X |
| 3,806,003 | 4/1974 | Fujimoto | 222/342 X |
| 4,188,907 | 2/1980 | Lipani | 222/DIG. 1 X |
| 4,492,321 | 1/1985 | Zoltner | 222/DIG. 1 X |
| 4,619,381 | 10/1986 | Wurtz | 222/342 X |
| 4,696,418 | 9/1987 | Kurotaka et al. | 222/DIG. 1 X |
| 4,739,907 | 4/1988 | Gallant | 222/DIG. 1 X |
| 4,784,081 | 11/1988 | Knott | 222/414 X |

FOREIGN PATENT DOCUMENTS 248307 3/1926 United Kingdom ..... 222/414

OTHER PUBLICATIONS

I.B.M. Technical Disclosure Bulletin, vol. 17, No. 4, Sep. 1974.

*Primary Examiner*—Andres Kashnikow
*Assistant Examiner*—Gregory L. Huson
*Attorney, Agent, or Firm*—Birch, Stewart, Kolasch & Birch

[57] ABSTRACT

A toner cartridge comprises a cylindrical cartridge body having a toner discharge port formed in a part of a peripheral surface thereof along its longitudinal direction, a pivot shaft disposed at the axis of the body, and a toner pressure feeding member joined to the pivot shaft through a plurality of connecting rods and adapted to discharge toner contained in the body from the toner discharge port. The toner pressure feeding member is disposed in parallel with the pivot shaft. Connecting rods, which are not locate in a position corresponding to the toner discharge port, are diagonally disposed with respect to the pivot shaft with an end of each of the group of connecting rods joined with the pivot shaft situated at the side where they attach toner discharge port. The group of connecting rods are provided at the side of the to with a toner guiding portion. Those connecting rods opposite the toner discharge port are perpendicular to the pivot shaft.

5 Claims, 3 Drawing Sheets

TONER CARTRIDGE

BACKGROUND OF THE INVENTION

1. Field of the Invention

This invention relates to a toner cartridge used for a copying machine.

2. Description of the Prior Art

A toner cartridge is very convenient as a toner feeding device because boner can be automatically fed to a developing tray by simply loading the toner cartridge containing the toner into a copying machine. As one representative example of such a toner cartridge, there is known a toner cartridge comprising a cylindrical cartridge body having a toner discharge port which is formed in a part of its peripheral surface along its longitudinal direction, a pivot shaft disposed at the axis of the cartridge body, and a toner pressure feeding member joined to the cartridge body through a plurality of connecting rods and adapted to discharge the toner contained in the cartridge body from the toner discharge port (Japanese Utility Model Early Laid-open Publication No. Sho 61-157962).

As toner has a very high fluidity, toner contained in a body of such a toner cartridge as mentioned above is moved to the toner discharge port as the toner is consumed and then discharged from the toner discharge port. However, toner which is in a position remote from the toner discharge port tends to remain in the body when the quantity of toner contained in the body becomes scarce.

In order to overcome the above mentioned shortcoming, there is proposed another toner cartridge as disclosed in Japanese Utility Model Early Laid-open Publication No. Sho 61-157962, which comprises a spiral scraping plate as a toner pressure feeding device so that toner, which tends to remain in the body, can be effectively transferred to the discharge port.

However, the above mentioned conventional toner cartridge has a such a problem that it is necessary to provide a space between the side edge of the scraping plate and the inner wall of the body in order to prevent a friction resistance from being generated therebetween and, as a result, provision of the spiral scraping plate is not sufficient for discharging all of the toner, some of which tends to remain in the body, into the discharge port. There is also another problem inherent in the above mentioned conventional toner cartridge, that is that much labor is required coupled with the necessity for making the space small in particular as mentioned.

SUMMARY OF THE INVENTION

It is therefore an object of the present invention to provide a toner cartridge capable of effectively discharging toner, which tends to remain in the cartridge body, from a toner discharge port and which is simple in structure.

The above object and others of the present invention can be achieved by providing a toner cartridge comprising a cylindrical cartridge body having a toner discharge port formed in a part of a peripheral surface thereof along its longitudinal direction, a pivot shaft disposed at the axis of the body, and a toner pressure feeding member joined to the pivot shaft through a plurality of connecting rods and adapted to discharge toner contained in the body from the toner discharge port, the toner pressure feeding member being disposed in a parallel relation with the pivot shaft, the group or plurality of connecting rods, none of which are located in a position corresponding to the toner discharge port, being diagonally disposed with respect to the pivot shaft such that an end of each of the connecting rods is joined with the pivot shaft situated at the side of the toner discharge port, the group of connecting rods being provided at the side in the pivoting direction with a toner guiding portion.

Also, the objective of the present invention can be more reliably achieved by forming a space between a side edge of the toner pressure feeding member that the inner wall of cartridge body and providing at the side edge a flexible film wider than the space over the entire length of the toner pressure feeding member.

Also, the object of the the present invention can be achieved by providing at one cartridge comprising a cylindrical cartridge body having a toner discharge port formed in a part of a peripheral surface thereof along its longitudinal direction, a pivot shaft disposed at the axis of the body, and a toner pressure feeding member joined to the pivot shaft through a plurality of connecting rods and adapted to discharge toner contained in the body from the toner discharge port, the toner pressure feeding member being disposed in parallel with the pivot shaft providing a space formed between a side edge of the toner pressure feeding member and an inner wall of the body, the toner pressure feeding member being provided at the side edge thereof with a flexible film wider than the space over the entire length of the pressure feeding member.

DETAILED DESCRIPTION OF THE PREFERRED EMBODIMENT

Figure 1:
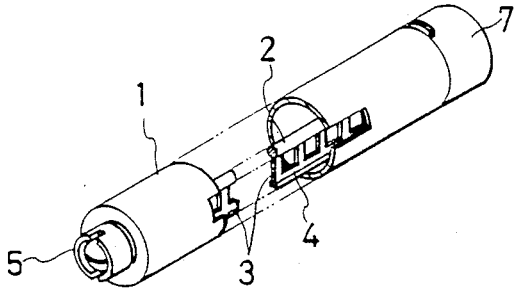
FIG. 1 is a perspective view, partly cutaway and partly omitted, of a toner cartridge according to one embodiment of the present invention.

The present invention will be described hereunder with reference to the preferred embodiment shown in FIGS. 1 through 11.

A toner cartridge according to the first embodiment of the present invention, as shown in FIGS. 1 through 7, comprises a cylindrical cartridge body 1, a pivot shaft 2 disposed along the axis of the cartridges body 1, and a toner pressure feeding member 4 connected with the pivot shaft 2 through a series of connecting rods 3 in such a manner as to be parallel with the cartridge body 1.

Furthermore, the cartridge body 1 is provided with a toner discharge port 1A formed at a part of the peripheral surface of the cartridge body 1 along its longitudinal direction. The arrangement is such that by connecting one end 5 of the pivot shaft 2 to a driving portion (not shown), toner contained in the cartridge body can be guided to the toner discharge port 1A by the toner pressure feeding member 4 and smoothly discharged from the toner discharge port 1A. The cartridge body 1 is terminated by a cap 7.

Also, between an inner wall of the cartridge body 1 and a side edge of the toner pressure feeding member 4, a tiny space is formed.

Figure 3:
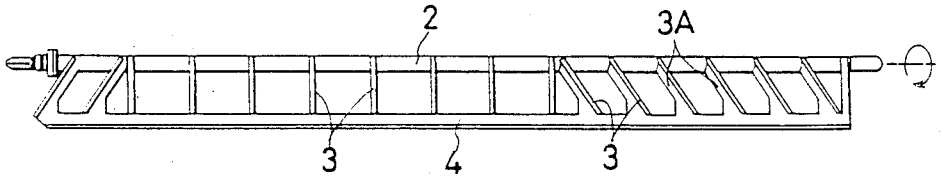
FIG. 3 is a perspective view showing the toner pressure feeding member removed from FIG. 2.
Figure 4:
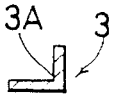
FIG. 4 is a sectional view of a connecting rod of the toner pressure feeding member of FIG. 3.
Figure 5:
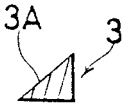
FIGS. 5, 6 and 7 are sectional views showing other examples of the connecting rod of the toner pressure feeding member.
Figure 6:
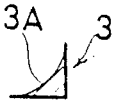
Figure 7:
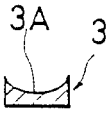

The toner pressure feeding member 4, as shown in FIG. 3, is mounted such that the connecting rods 3 are perpendicular to the pivot shaft 2 and the toner pressure feeding member 4 at a region corresponding to the toner discharge port 1A, whereas the inner ends (the ends where the connecting rods are joined with the pivot shaft 2) are diagonal with the direction of the toner discharge port 1A in the region other than the toner discharge port 1A.

Figure 2:
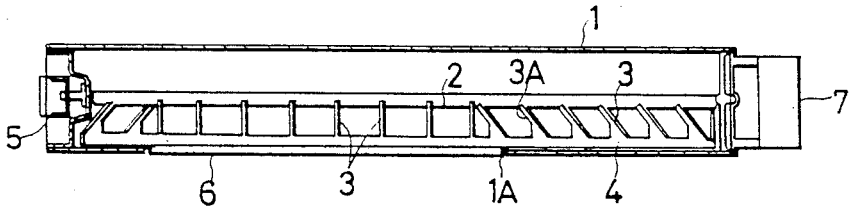
FIG. 2 is a sectional side view taken at a position including a toner discharge portion of a cartridge body of the embodiment shown in FIG. 1.

Furthermore, in order than toner does not remain in the space between the inner wall of the cartridge body 1 and the toner pressure feeding member 4, a flexible film 6 having a width wider than the space is disposed, in this embodiment, along the side edge of the toner pressure feeding member 4 in such a manner as to correspond to the longitudinal dimension of the toner discharge port 1A of the cartridge body 1, as shown in FIG. 2.

Therefore, according to the toner cartridge of this embodiment, by means of the pivotal movement of the one end 5 of the pivot shaft 2, toner, which is in position remote from the toner discharge port 1A, can be scraped from the inner wall of the cartridge body 1 by the toner pressure feeding member 4, and such scraped toner can be guided toward the side of the toner discharge port 1A. The toner guided toward the side of the toner discharge port 1A is completely wiped out by the flexible film 6 and effectively discharged from the toner discharge port 1A without allowing any toner to remain in the cartridge body 1. Moreover, as the toner cartridge of this embodiment is simple in configuration with respect to its pivot shaft 2, connecting rods 3, and toner pressure feeding member 4, manufacturing and mounting thereof are very easy.

Furthermore, the connecting rods 3, as shown in FIG. 3, are provided at the side where they connect with the pivot shaft 2 with toner guiding portions 3A adapted to guide toner to the discharge port 1A so that toner can be effectively fed to the toner discharge port 1A by the toner guiding portions 3A. Although, the connecting rods 3 are formed into a configuration as shown in section in FIG. 4, the present invention is by no means limited to this configuration. For example, the sectional configuration of the connecting rods may be formed something like those shown in FIGS. 5, 6 and 7.

Figure 8:
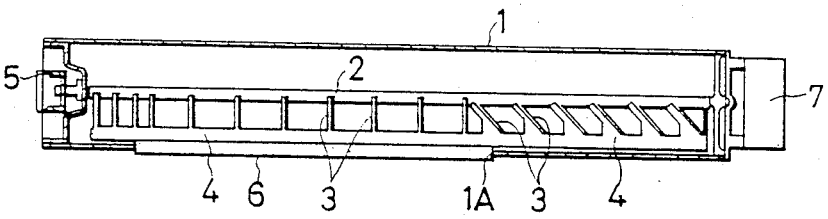
FIG. 8 is a view corresponding to FIG. 2, but showing a second embodiment of the present invention.

A toner cartridge according to a second embodiment of the present invention is constructed in the same manner as that of the first embodiment except that only a group of the connecting rods 3 at the right-hand side of the outer discharge port 1A, as shown in FIG. 8, are inclined as in the first embodiment and all the remaining connecting rods 3 are mounted between the pivot shaft 2 and the toner pressure feeding member 4 in such a manner as to be perpendicular thereto.

Figure 9:
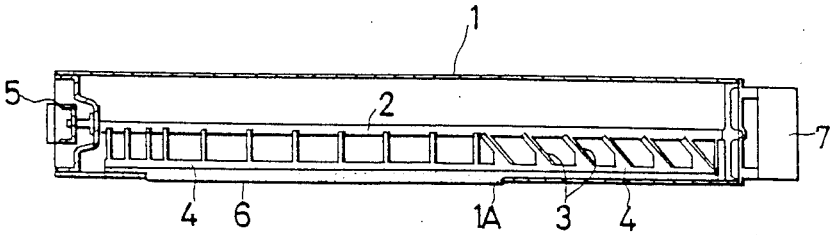
FIG. 9 is a view corresponding to FIG. 2, but showing a third embodiment of the present invention.

Also, a toner cartridge according to a third embodiment of the present invention is constructed in the same manner as that of the second embodiment shown in FIG. 3 except that the flexible film 6 is disposed over the entire length of the side edge of the toner pressure feeding member 4, as shown in FIG. 9.

Figure 11:
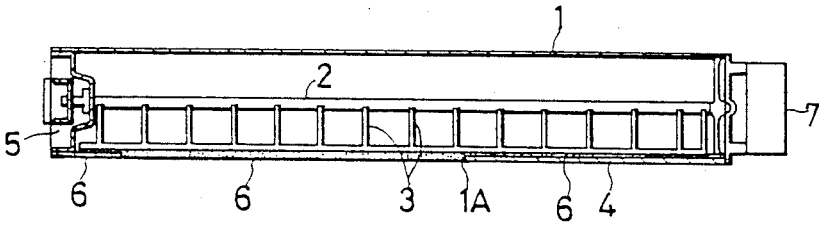
FIG. 11 is a view corresponding to FIG. 2, but showing a fourth embodiment of the present invention.

A toner cartridge according to a fourth embodiment of the present invention is constructed in the same manner as that of the third embodiment except that the connecting rods 3 for interconnecting the pivot shaft 2 and the toner pressure feeding member 4 are all perpendicular to the pivot shaft 2 and the toner pressure feeding member 4, as shown in FIG. 11. Accordingly, this embodiment can also provide generally the same effect as the above-mentioned embodiments.

Figure 10:
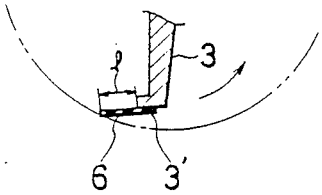
FIG. 10 is a sectional view showing an important portion of one embodiment of the present invention.

The toner cartridge of the present invention is preferably designed as such that the toner pressure feeding member is provided with a flexible film. As a material of this flexible film 6, there can be listed, for example, polyethyleneterephthalate, nylon, drawn polypropylene, polystyrene, vinyl chloride or the like. The flexible film 6 may be disposed as such that it has a width wider than the space formed between the toner pressure feeding member 4 and the inner wall of the cartridge body 1. It is preferable, however, that the side edge 3′ of each of the connecting rods 3 is formed into a configuration as shown in FIG. 10 and at that time, the flexible film 6 is mounted in such a manner as to have a width wider than the length l shown in FIG. 10.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A toner cartridge comprising a cylindrical cartridge body having a toner discharge port formed in a part of a peripheral surface thereof, a pivot shaft disposed along a longitudinal axis of said body and a toner pressure feeding member within said cartridge body joined to said pivot shaft through a plurality of connecting rods and adapted to discharge toner contained in said body from said toner discharge port, said toner pressure feeding member being disposed in parallel with said pivot shaft and along a portion of said cartridge body length which includes said discharge port, said connecting rods corresponding to the pressure feeding member of said toner discharge port being perpendicular to said pivot shaft while the remaining connecting rods are diagonally disposed with respect to said pivot shaft, said diagonal connecting rods being provided where they connect with said pivot shaft with a counter guiding portion to direct toner towards the outlet.

2. A toner cartridge as in claim 1, wherein a space is provided between an edge of said toner pressure feeding member and an inner wall of said cartridge body and a flexible film, greater in dimension than said space, is provided over the entire length of said toner pressure feeding member at said edge of said toner pressure feeding member.

3. The toner cartridge of claim 2, wherein said flexible film is provided on said toner pressure feeding member at said edge portion corresponding to said toner discharge port.

4. A toner cartridge comprising a cylindrical cartridge body having a toner discharge port formed in a part of a peripheral surface thereof along its longitudinal direction, a pivot shaft disposed along an axis of said body and a toner pressure feeding member joined to said pivot shaft through a plurality of connecting rods, adapted to discharge toner contained in said body from said toner discharge port, said toner pressure feeding member being disposed in parallel with said pivot shaft such that a space is formed between an edge of said toner pressure feeding member and an inner wall of said body, said toner pressure feeding member being provided at said edge with a flexible film greater in dimension than said space over the entire length of said toner pressure feeding member.

5. A toner cartridge as in claim 4, wherein each of said connecting rods is located in such a manner as to be perpendicular to said pivot shaft.

* * * * *